United States Patent [19]

Zetah

[11] 4,133,496

[45] Jan. 9, 1979

[54] WATER SKI TOW ROPE RETRIEVER

[76] Inventor: Richard H. Zetah, 1005 - 14th Ave., S.E., Willmar, Minn. 56201

[21] Appl. No.: 849,395

[22] Filed: Nov. 7, 1977

[51] Int. Cl.[2] ..... B65H 75/40

[52] U.S. Cl. ..... 242/86.5 A; 114/254

[58] Field of Search ..... 242/86.5 A, 86.5 R, 242/54, 107; 114/242, 253, 254; 115/6.1

[56] References Cited

U.S. PATENT DOCUMENTS

| | | | |
|---|---|---|---|
| 3,027,116 | 3/1962 | Holloway | 242/86.5 A |
| 3,098,463 | 7/1963 | Brown | 242/86.5 A X |
| 3,162,395 | 12/1964 | Bray | 242/86.5 A |
| 3,420,466 | 1/1969 | Sanders | 114/254 |
| 3,456,891 | 7/1969 | Parr | 242/86.5 A X |

*Primary Examiner*—Edward J. McCarthy
*Attorney, Agent, or Firm*—Clarence A. O'Brien; Harvey B. Jacobson

[57] ABSTRACT

A mount is provided defining a portion for attachment to the rear surface of the transom of a boat and a reel is journaled from the mount. The reel includes a center hub portion and end flange structure at one end of the hub portion including inner and outer sides. The mount further includes anchor structure generally concentric with the axis of rotation of the reel and disposed on the outer side of the flange structure. The flange structure has an opening formed therethrough and an elongated flexible pull member is provided and has one end thereof passed through the opening from the inner side of the flange structure to the outer side thereof and anchored to the anchor structure for rotation of the pull member end relative to the anchor structure about the aforementioned axis. The opening defines a passage through which the pull member may extend in substantially straight condition from the anchor structure through the passage when the other end portion of the pull member extends generally radially outwardly away from the reel.

12 Claims, 5 Drawing Figures

WATER SKI TOW ROPE RETRIEVER

BACKGROUND OF THE INVENTION

The water ski tow rope retriever of the instant invention is designed for use on the aft portion of a boat behind which water skiers are to be pulled. Conventionally, one or more water ski ropes are pulled behind a boat and each rope is approximately 75 feet in length. When a water skier falls, the boat operator conventionally turns his boat and pilots it back to the fallen skier and then must navigate his boat in a manner to "bring" the free end of the tow rope to the skier in the water before water skiing may be resumed. During this time, the trailing of a 75 foot length of tow rope behind a boat constitutes a hazard to navigation of nearby boats. Further, when a plurality of skiers are being pulled behind a boat and one of the skiers fall, it then becomes very difficult for the operator of the boat to return to the skiers (the remaining skiers usually "dropping off" when one of their party falls) without the plurality of tow ropes becoming entangled and for the operator of the boat to position all of the trailed tow ropes in a manner such that they may be retrieved by the skiers in the water. Also, each time a skiing operation is terminated, the tow rope or ropes being used must be retrieved and coiled for storage and the storage of a plurality of coiled tow ropes on a boat without causing entanglement of the ropes is difficult.

Accordingly, a need exists for structure whereby one or more water ski tow ropes may be readily retrieved and supported from the transom of the associated tow boat in readiness to be subsequently quickly extended whenever a skiing operation is to be initiated.

Although various forms of water ski tow rope and other rope retrievers have been heretofore designed, such as those disclosed in U.S. Pat. Nos. 3,085,543, 3,100,606, 3,195,831, 3,456,891, 3,813,055, and 3,886,888, these previously known rope retrievers have, for various reasons, not proven to be operative to perform all of the desired functions of a water ski tow rope retriever.

SUMMARY OF THE INVENTION

The water ski tow rope retriever of the instant invention has been specifically designed for support from the aft portion of a boat to be utilized in towing water skiers and includes a journaled reel upon which a water ski tow rope is wound. The reel is journaled in a manner yieldably resisting rotation of the reel in a direction to unwind the associated tow rope therefrom and is equipped with an electric motor whereby the reel may be actuated to quickly retrieve a water ski tow rope whenever desired. Further, the water ski tow rope retriever includes mounting structure which is particularly well adapted to support the retriever from the rearward facing outer surface of the transom of a tow rope and in a manner such that the retriever may be automatically swung to a retracted inoperative position when not in use.

The main object of this invention is to provide a water ski tow rope retriever which may be readily actuated to quickly retrieve an associated water ski tow rope.

Another object of this invention is to provide a water ski tow rope retriever in accordance with the preceding object and including mounting structure therefor whereby the retriever may be automatically swung to a stored inoperative position during each period of non-use thereof.

Still another object of this invention is to provide a water ski tow rope retriever adaptable for mounting from conventional stern eye structure.

Another very important object of this invention is to provide a reel equipped water ski tow rope retriever with which an associated water ski tow rope may be operatively connected for winding and unwinding therefrom and with the tow rope associated with the reel in a manner such that a pull on the tow rope during its use will not be transferred to the mounting of the retriever through the reel thereof.

A final object of this invention to be specifically enumerated herein is to provide a water ski tow rope retriever in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
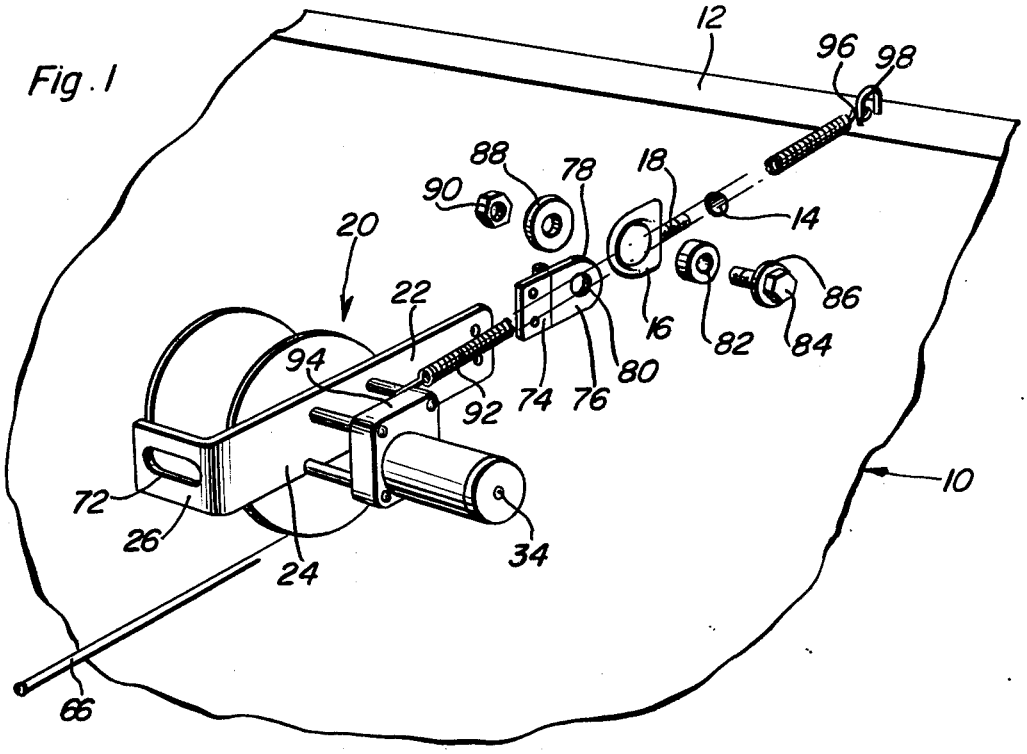
FIG. 1 is an exploded perspective view of the water ski tow rope retriever in exploded position relative to the transom of a tow boat.

Referring now more specifically to the drawings, the numeral 10 generally designates a boat including a rear transom 12 having a bore 14 formed therethrough. A transom eye 16 is provided and includes a threaded shank portion 18 secured through the transom 12 in a conventional manner.

The water ski tow rope retriever of the instant invention is referred to in general by the reference numeral 20 and includes a mount 22 which is generally L-shaped in configuration having a long leg 24 and a short leg 26. The longitudinal midportion of the long leg 24 has a reduction gear motor assembly referred to in general by the reference numeral 28 mounted thereon by means of suitable fasteners 30. The assembly 28 includes an electric motor 32 having a rotatable output shaft 34 drivingly connected to a gear reduction transmission 36 including an output shaft 38. The long leg 24 includes a large opening 40 formed therein through which a stationary sleeve-type anchor member 42 is secured by means of a threaded nut 44. The free end of the output shaft 38 projects into the adjacent end of the anchor member 42 and is telescopingly received within a blind bore 46 formed in one end of a support shaft 48 journaled through the anchor member 42. The support shaft 48 is secured in position on the output shaft 38 by means of a set screw 50 and a reel referred to in general by the reference numeral 52 is mounted on the outer free end of the shaft 48 and is secured thereon against rotation relative thereto by means of a removable diametric pin 54. The outer terminal end 56 of the shaft 48 projects outwardly beyond the reel 52 and has a hemispherical resilient bumper or cushion member 58 mounted thereon.

The end of the sleeve 42 adjacent the reel 52 includes a bell shaped diametrically enlarged end 60 thereon and the reel 52 includes inner and outer end flanges 62 and 64 between which a tow rope 66 may be wound on the hub 68 of the reel 52.

Figure 5:
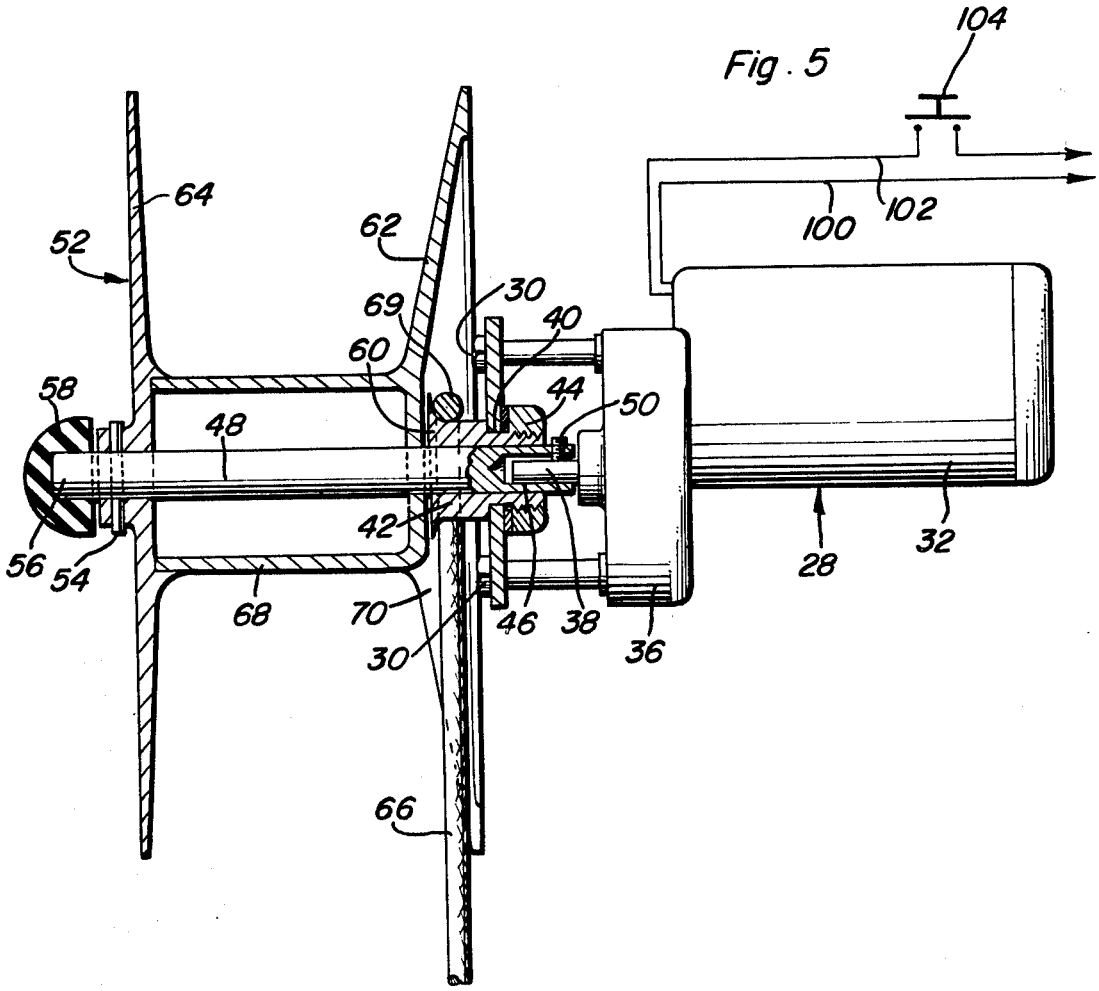
FIG. 5 is a rear elevational view of the tow rope retriever on somewhat of an enlarged scale and with portions thereof being broken away and illustrated in vertical section.

The end flange 62 includes a radial slot or opening 70 formed therein terminating at its outer end inwardly of the outer periphery of the end flange 62 and it may be seen from FIG. 5 of the drawings that the end flange 62 is inclined slightly whereby the base end of the tow rope 66 may have an eye 69 formed therein extending about the sleeve-type anchor member 42 in order to anchor the tow rope or line 66 to the anchor member 42. Further, it may also be seen from FIG. 5 of the drawings that the tow rope 66 may extend in a straight path radially outwardly from the sleeve-type anchor member 42 through the opening or slot 70 when the tow rope 66 extends generally radially outwardly from the sleeve-type anchor member 42. Also, the right angulated short leg 26 of the mount 22 includes an elongated slot 72 formed therein through which the tow rope 66 extends.

The end of the long leg 24 remote from the short leg 26 has a hinge structure 74 supported therefrom and a short arm 76 is supported by means of the hinge structure 74 from the leg 24 for relative swinging of the long leg 24 and the arm 76 about an axis disposed substantially normal to the axis of rotation of the reel and transverse to the leg 24. The outer free end 78 of the arm 76 is provided with a transverse opening 80 therein and a sleeve 82 is rotatably mounted on the arm 76 by means of a threaded fastener 84 secured through the sleeve 82, the opening 80 and a pair of washers 86 and 88. The fastener 84 is utilized to secure the sleeve 82 through the eye 16 with the washer 86 disposed between one side of the eye 16 and the head of the fastener 84, the arm 76 disposed on the other side of the eye 16 and the washer 88 disposed between the nut 90 threadedly engaged with the fastener 84 and the side of the arm 76 remote from the eye 16. In this manner, the arm, although frictionally retained in adjusted position, may be rotated about the longitudinal axis of the fastener 84 relative to the eye 16. Still further, an elongated expansion spring 92 is provided and has one end thereof anchored relative to the assembly 28 as at 94 and the other end thereof releasably anchored as at 96 to an anchor member 98 carried by the transom 12.

In operation, one end of the tow rope 66 is threaded through the slot 70 from the inner side of the end flange 62 and has the eye 69 thereon loosely engaged about the sleeve-type anchor member 42. It is to be noted that the eye 69 may be replaced by a suitable anchor member rotatably mounted on the sleeve-type anchor member 42 and to which the end of the tow rope 66 may be anchored.

The electric motor 32 is electrically connected by means of a pair of conductors 100 and 102 to a suitable source (not shown) of electrical potential and the conductor 102 has a push-button switch 104 serially connected therein. The push-button switch 104 may be situated adjacent the helm of the boat 10 whereby the switch 104 may be readily actuated by the operator of the boat 10 whenever desired.

Assuming that the tow rope 66 is wound on the reel 52, when it is desired to proceed with water skiing operations, a water skier disposed immediately behind the transom 12 may grasp the free end of the tow rope 66 and pull on the rope in order to cause rotation of the reel 52 in a direction to unwind the free end of the tow rope therefrom. After all of the tow rope 66 has been unwound from the reel, the operator of the boat 10 may pull the water skier. Should the water skier fall or for any other reason it is desired to reel in the rope 66, it is merely necessary for the operator of the boat to actuate the switch 104. The motor 32 will then cause the output shaft 38 to be rotated and the end of the tow rope 66 extending through the slot 70 will be wound on the reel. The gear reduction assembly or transmission 36 includes reduction gears (not shown) such that the reel 52 will not be freely rotatable when the motor 32 is not in operation, but rotation of the reel 52 independent of operation of the motor 32 will be only yieldingly resisted to the extent that a rearward pull on the rope 66 may effect unwinding of the free end of the rope 66 from the reel.

Figure 2:
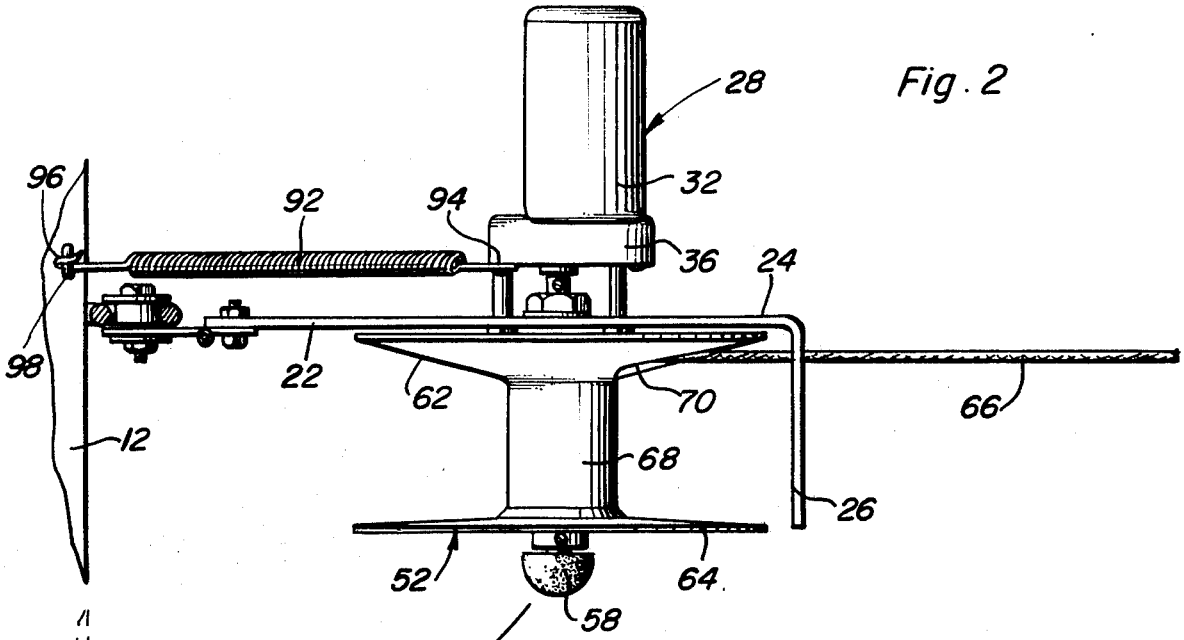
FIG. 2 is a fragmentary, top plan view of the aft portion of the tow boat with the water ski tow rope retriever operatively mounted thereon.
Figure 3:
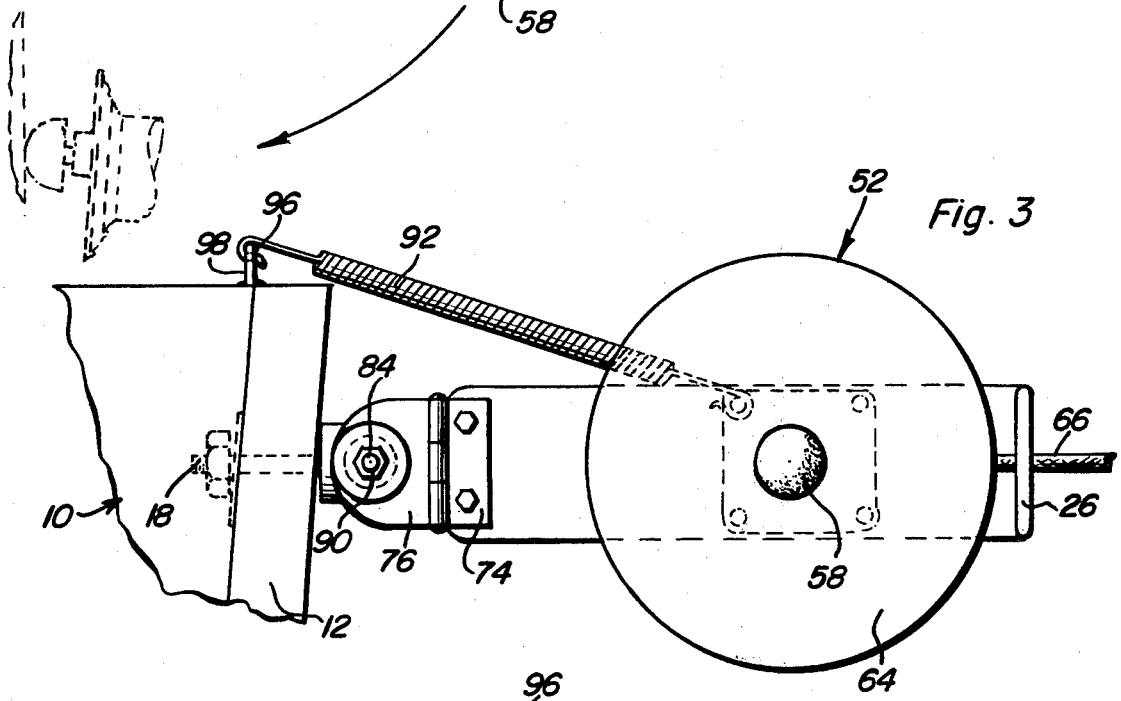
FIG. 3 is a side elevational view of the assemblage illustrated in FIG. 2.
Figure 4:
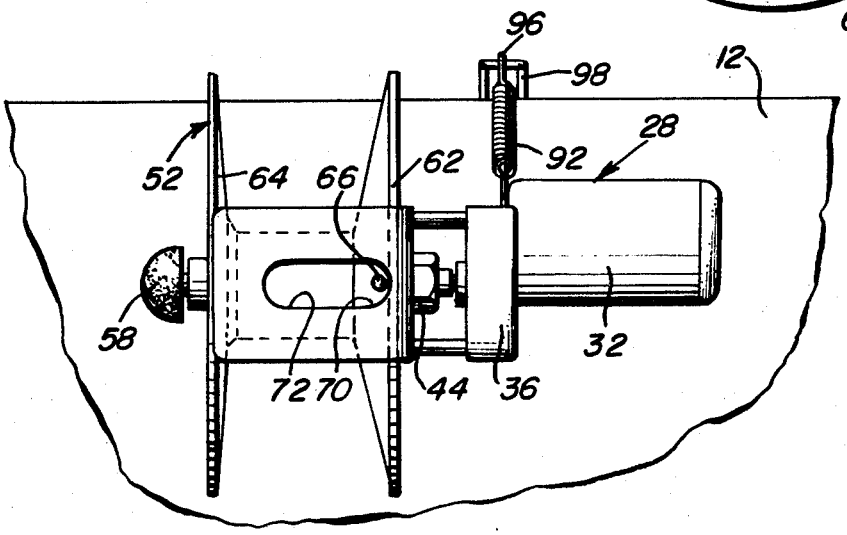
FIG. 4 is a rear elevational view of the assemblage illustrated in FIG. 2.

When the retriever 20 is not in use, the mount 22 may be swung slightly in a clockwise direction as viewed in FIG. 2 of the drawings in order to swing the spring 92 to an over center position passed which the spring 92 will then swing the mount 22 to a position with the abutment or cushion 58 engaged with the rear outer surface of the transom 12 in the manner illustrated in phantom lines in FIG. 2.

It is additionally pointed out that the rearward pull on the tow rope 66 when the boat 10 is being utilized to pull a skier therebehind is transferred directly to the sleeve-type abutment member 42 and thereafter to the long leg 24, the hinge assembly 74, the arm 76 and the eye 16. Thus, all pull on the reel 52 is relieved during operation of the boat 10 to pull a water skier.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A reel assembly including a mount, a reel journaled from said mount, said reel including a center hub portion and end flange means at one end of said hub portion including inner and outer sides, said mount further including anchor structure generally concentric with the axis of rotation of said reel and disposed on the outer side of said flange means, said flange means defining an opening therethrough, an elongated, flexible pull member for winding on and unwinding from said reel, one end of said pull member being passed through said opening from the inner side of said flange means to the outer side thereof and anchored to said anchor structure for rotation of said one end relative to said anchor structure about said axis with said reel, said opening being disposed on a radius of said axis and defining a passage through which said pull member may extend in substantially straight condition from said anchor structure to a point remote from said reel when the other end portion of said pull member is unreeled from said reel and extends generally radially outwardly therefrom.

2. The combination of claim 1 wherein the other end of said hub portion includes second end flange means.

3. The combination of claim 1 wherein said mount includes an elongated arm portion extending generally radially of said axis and including a first end anchored relative to said anchor structure, said arm portion disposed outwardly of said end flange and closely adjacent the latter.

4. The combination of claim 3 wherein the outer end of said arm portion includes hinge means, a short arm having one end thereof pivotally supported, by said hinge means, from said outer end of said arm portion for swinging relative thereto about a second axis generally normal to the first mentioned axis, the other end of said short arm including mounting means for mounting said arm from a rearwardly facing boat transom with said short arm extending rearwardly from said transom and said second axis disposed in upstanding position.

5. The combination of claim 4 wherein the other end portion of said hub means includes endwise outwardly facing and projecting abutment means, and an elongated expansion spring having one end thereof anchored relative to said mount and adapted at the other end thereof for anchoring to said transom.

6. The combination of claim 5 wherein said mounting means on said one end of said short arm includes means defining a pivot axis extending transverse to said short arm and normal to said second axis.

7. The combination of claim 1 including motor means supported from said mount and drivingly connected to said reel.

8. The combination of claim 7 wherein said motor means comprises an electric motor including a rotatable output shaft, said output shaft being connected to said reel through a reduction gear assembly, said reduction gear assembly including gear means enabling said output shaft to be rotated by rotary torque applied to said reel.

9. The combination of claim 8 wherein the other end of said hub portion includes second end flange means.

10. The combination of claim 9 wherein said mount includes an elongated arm portion extending generally radially of said axis and including a first end anchored relative to said anchor structure, said arm portion disposed outwardly of said end flange and closely adjacent the latter.

11. A water ski tow rope retriever, said retriever including a mount defining a portion for attachment to a boat, a reel journaled from said mount, said reel including a center hub portion and end flange means at one end of said hub portion including inner and outer sides, said mount further including anchor structure generally concentric with the axis of rotation of said reel and disposed on the outer side of said flange means, an elongated, flexible pull member engaged with said reel for winding on and unwinding from said reel, said mount including an elongated arm portion extending generally radially of said axis and including a first end anchored relative to said anchor structure, said arm portion disposed outwardly of said end flange and closely adjacent the latter, the outer end of said arm portion including hinge means, a short arm having one end thereof pivotally supported, by said hinge means, from said outer end of said arm portion for swinging relative thereto about a second axis generally normal to the first mentioned axis, the other end of said short arm including mounting means for mounting of said arm from a rearwardly facing boat transom with said short arm extending rearwardly from said transom and said second axis disposed in upstanding position, the other end portion of said hub means including endwise outwardly facing and projecting abutment means, and an elongated expansion spring having one end thereof anchored relative to said mount and adapted at the other end thereof for anchoring to said transom.

12. The combination of claim 11 wherein said mounting means on said one end of said short arm includes means defining a pivot axis extending transverse to said short arm and normal to said second axis.

* * * * *